US009902411B2

(12) United States Patent
Bartek et al.

(10) Patent No.: US 9,902,411 B2
(45) Date of Patent: Feb. 27, 2018

(54) WORK BLOCK ENCROACHMENT WARNING SYSTEM

(71) Applicant: HARSCO TECHNOLOGIES LLC, Fairmont, MN (US)

(72) Inventors: Peter Michael Bartek, Ledgewood, NJ (US); Michael Stephen Davis, Westminster, MD (US)

(73) Assignee: HARSCO TECHNOLOGIES LLC, Fairmont, MN (US)

( * ) Notice: Subject to any disclaimer, the term of this patent is extended or adjusted under 35 U.S.C. 154(b) by 242 days.

(21) Appl. No.: 14/873,609

(22) Filed: Oct. 2, 2015

(65) Prior Publication Data

US 2016/0096539 A1 Apr. 7, 2016

Related U.S. Application Data

(60) Provisional application No. 62/071,817, filed on Oct. 3, 2014.

(51) Int. Cl.

| | |
|---|---|
| ***B61L 23/34*** | (2006.01) |
| ***B61L 23/06*** | (2006.01) |
| ***B61L 25/02*** | (2006.01) |
| ***B61L 25/04*** | (2006.01) |
| ***G08B 21/02*** | (2006.01) |

(52) U.S. Cl.

CPC ..... *B61L 23/34* (2013.01); *B61L 23/06* (2013.01); *B61L 25/026* (2013.01); *B61L 25/028* (2013.01); *B61L 25/04* (2013.01); *G08B 21/02* (2013.01); *B61L 2205/04* (2013.01)

(58) Field of Classification Search

CPC ..... B61L 1/00; B61L 1/02; B61L 1/18; B61L 3/00; B61L 3/02; B61L 3/06; B61L 3/08; B61L 3/16; B61L 23/00; B61L 23/06; B61L 23/08; B61L 23/34

See application file for complete search history.

(56) References Cited

U.S. PATENT DOCUMENTS 5,924,651 A 7/1999 Penza et al.
6,145,792 A * 11/2000 Penza ..... B61L 23/06 246/122 R
6,232,887 B1 5/2001 Carson
(Continued)

FOREIGN PATENT DOCUMENTS

DE 4428784 A1 2/1996
DE 102004053163 A1 6/2005
(Continued)

OTHER PUBLICATIONS

International Search Report and Written Opinion of PCT/US2015/053697 dated Feb. 23, 2016.

*Primary Examiner* — Robert J McCarry, Jr.
(74) *Attorney, Agent, or Firm* — Baker & McKenzie LLP

(57) ABSTRACT

The present disclosure generally relates to work block encroachment warning systems for providing protection for rail workers working in a mobile or fixed work block. For example, a vehicle (V)-aware unit installed on a moving rail vehicle and a work block limit encroachment unit mounted on a railroad may wirelessly communicate with each other to determine a distance between them. When a vehicle is moving toward an occupied work block, the distance may be used to identify potential hazards.

17 Claims, 5 Drawing Sheets

(56) References Cited

U.S. PATENT DOCUMENTS

| | | | | |
|---|---|---|---|---|
| 6,471,162 | B1 * | 10/2002 | Pace | B61L 23/06 246/124 |
| 7,075,427 | B1 | 7/2006 | Pace et al. | |
| 2005/0010338 | A1 * | 1/2005 | Kraeling | B61L 3/121 701/19 |
| 2011/0006912 | A1 | 1/2011 | Sheardown et al. | |
| 2012/0296562 | A1 | 11/2012 | Carlson et al. | |
| 2012/0306664 | A1 | 12/2012 | Geter | |

FOREIGN PATENT DOCUMENTS

| | | | |
|---|---|---|---|
| DE | 102008046565 | A1 | 3/2010 |
| JP | 2010-7452 | A | 1/2010 |

* cited by examiner

WORK BLOCK ENCROACHMENT WARNING SYSTEM

CROSS-REFERENCE TO RELATED APPLICATIONS

This application claims priority to U.S. Provisional Application No. 62/071,817, filed Oct. 3, 2014 and entitled "Work Block Encroachment System," which is hereby incorporated by reference in its entirety.

BACKGROUND

Railroads are generally constructed of a pair of elongated, substantially parallel rails, which are coupled to a plurality of laterally extending ties via metal tie plates and spikes and/or spring clip fasteners. After construction railroads may require regular maintenance. When maintaining a railroad, workers are expected to stay within a certain work area and refrain from encroaching other undesignated work areas.

Currently work area boundaries may often be marked by location chain markers or wayside flags near boundaries. Thus, operators of rail vehicles may need to rely on their line of sight to see boundary markers. However, while driving a rail vehicle, an operator may sometimes overlook the boundary markers, for example, when he or she is not paying close attention or when the markers are not readily discernable. As a result, an operator may drive the rail vehicle past the boundary of a designated work area or encroach another non-designated work area. Such violation may create potential dangers of collision with other vehicles or on-track workers. Therefore, it is desirable to design additional warning mechanisms for increased safety.

BRIEF SUMMARY

The present disclosure generally relates to providing protection for rail workers working in a mobile or fixed work block using a work block encroachment warning system. According to some aspects of the present disclosure, a vehicle (V)-aware unit installed on a moving rail vehicle and a work block limit encroachment unit mounted on a railroad may make up an exemplary work block encroachment warning system.

In some embodiments, a work block limit encroachment unit may comprise a magnet configured to magnetically couple to the web of a running rail, a transceiver configured to wirelessly communicate with a V-aware unit, and a processor configured to determine, based on the communication, a distance between the work block limit encroachment unit and the rail vehicle. A work block limit encroachment unit may identify a violation of safety rules when the distance drops below a pre-determined threshold, and may issue visual and/or audio warnings to nearby rail workers.

In some embodiments, a V-aware unit may communicate with a work block limit encroachment unit in order to determine and display a distance to the encroachment unit and other vehicles equipped with V-aware units. A V-aware unit may alarm a vehicle operator before the vehicle encroaches an undesignated work block or exits a designated work block. At least one of the V-aware unit and the encroachment unit may store data logs that record violation events. Rule violations may be reported to a control center as well. The present disclosure may provide a safer procedure for track access in order for rail workers to perform track maintenance or repair during revenue hours or with test trains or maintenance vehicles operating during repair.

BRIEF DESCRIPTION OF THE DRAWINGS

Reference is now made to the following descriptions taken in conjunction with the accompanying drawings.

DETAILED DESCRIPTION

Various embodiments of work block encroachment warning systems and associated procedures and methods of using such systems according to the present disclosure are described. It is to be understood, however, that the following explanation is merely exemplary in describing the devices and methods of the present disclosure. Accordingly, various modifications, changes and substitutions are contemplated.

Figure 1:
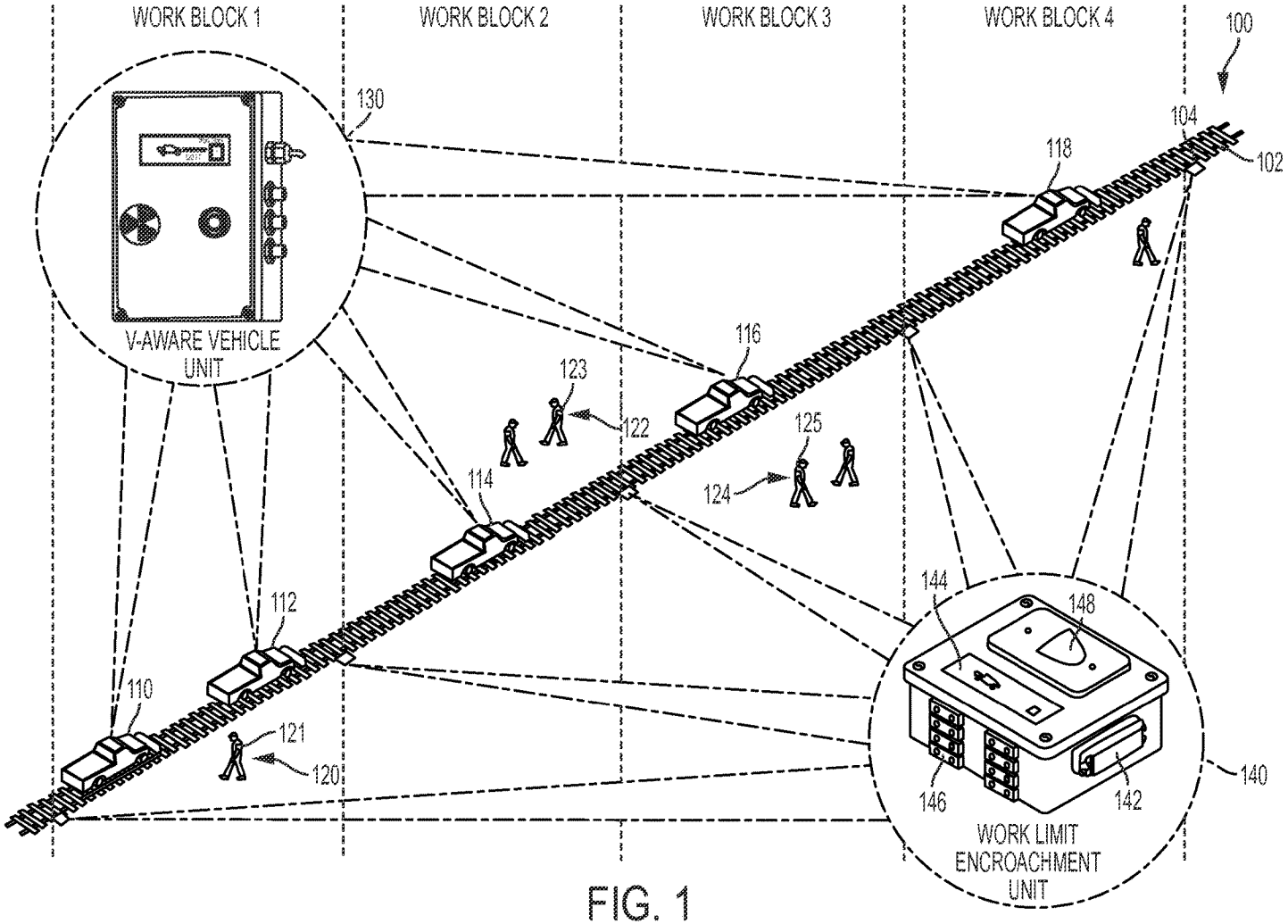
FIG. 1 illustrates a perspective view of a railroad section with exemplary work block encroachment warning systems according to the present disclosure deployed therein.

FIG. 1 is a schematic diagram illustrating a railroad section 100 in which exemplary embodiments of work block encroachment warning systems are deployed. Although the present disclosure uses railroad as an example application, the disclosed principles may be similarly applied to any other appropriate industrial setting. As shown in FIG. 1, the railroad section 100 may comprise one or more work blocks such as Work Blocks 1-4. Various rail vehicles (e.g., vehicles 110, 112, 114, 116, and 118, which may be trains and/or maintenance vehicles) and personnel (e.g., workers 120, 122, and 124) may conduct rail-related work in these work blocks. Each rail vehicle may be equipped with a purpose-built Vehicle (V)-aware unit 130. In addition, a plurality of purpose-built work block limit encroachment units (in short as encroachment units) 140 may be deployed on a running rail in the rail section 100, each at (or close to) a work block boundary. The V-aware units 130 and the encroachment units 140 together make up the work block encroachment warning systems disclosed herein.

Figure 2:
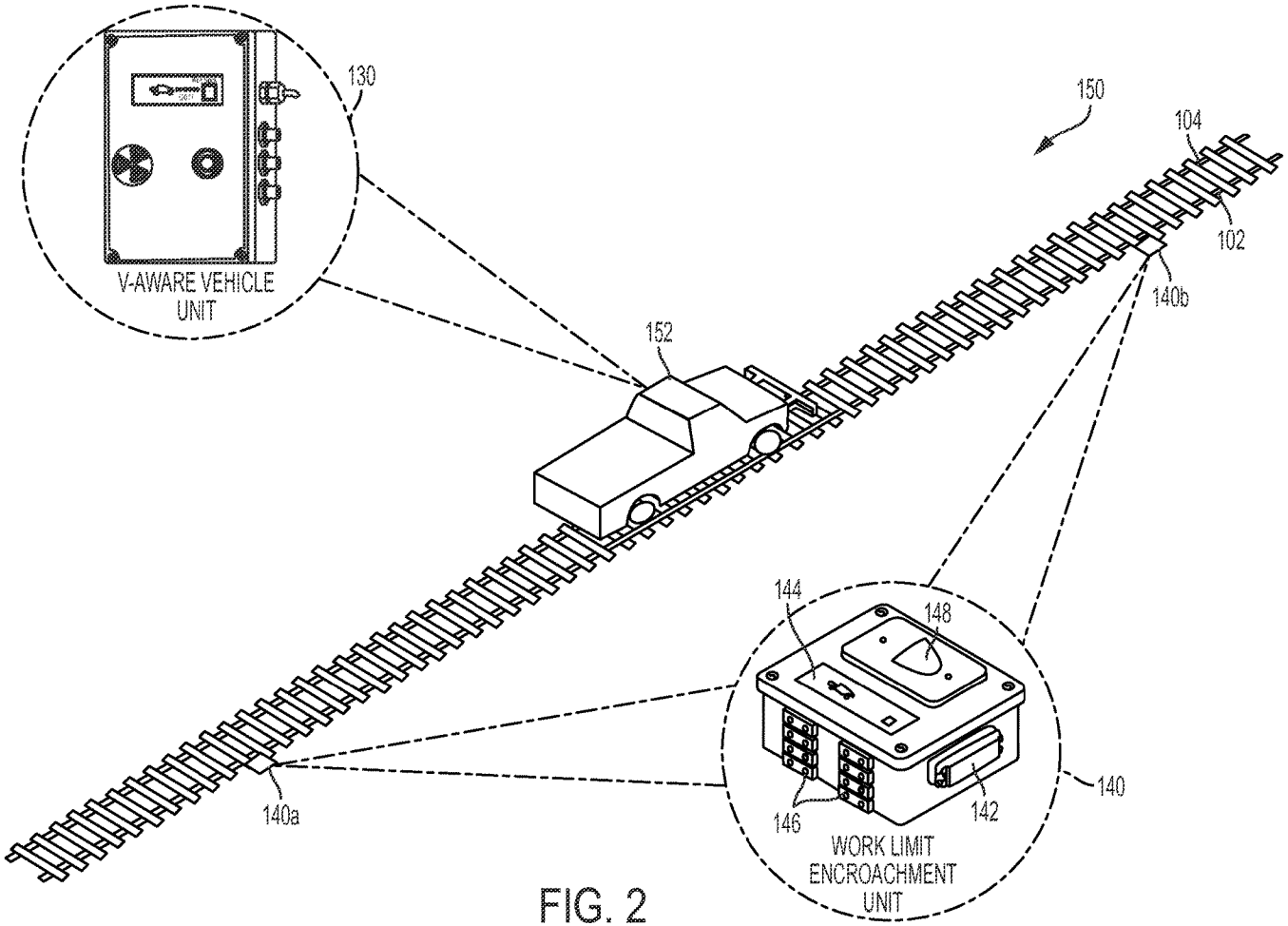
FIG. 2 illustrates a close-up perspective view of a work block encroachment warning system, comprising a vehicle (V)-aware unit and two work block limit encroachment units, from FIG. 1.

FIG. 2 provides a close-up view of an exemplary embodiment of a work block encroachment warning system 150, which may be used in a work block such as any of the Work Blocks 1-4 shown in FIG. 1. A work block, sometimes referred to work area or work zone, may be a section of a railroad authorized or designated for rail-related activities such as construction and/or maintenance works. A work block may have any suitable length, e.g., ranging from hundreds of feet to tens of miles. A work block may or may not have another work block adjacent to it. Thus, the Work Blocks 1-4 may or may not be contiguous. Sometimes there may be only one work block for a stretch of railroad, and the rest is undesignated areas.

The system 150 may comprise a V-aware unit 130 and one or more encroachment units 140 (e.g., two encroachment units denoted as 140*a* and 140*b* in FIG. 2). The V-aware unit 130 may be installed on a vehicle 152, which may represent any of the vehicles 110-118 in FIG. 1. The V-aware unit 130 and the encroachment units 140 are not necessarily in the same work block (e.g., when a vehicle 152 is outside the work block). An encroachment unit 140 may be mounted as a wayside unit on a first rail 102, a second rail 104, or both. In some embodiments, for example, the encroachment units 140 may be magnetically and removably coupled to the web of the rail 102, with a first encroachment unit 140*a* located near the start of the work block, and a second encroachment unit 140*b* located near the end of the work block. An encroachment unit 140 may be attached to either side (on an inner side or an outer side) of the web of the rail 102.

In some embodiments, the encroachment unit 140 as shown in FIG. 2 may comprise at least one visual alarm 142, a display 144, a magnet mounting arrangement 146, and an audio alarm 148. Magnetic coupling is enabled by the magnet mounting arrangement 146, which may comprise one or more magnets of any suitable size and/or shape. For example, as shown in FIG. 2, the magnet mounting arrangement 146 comprises a plurality of magnets arranged in an array. Magnetic coupling has advantages over traditional clamp-type devices, which may require digging into ballast when placing a clamp around the rails. For example, during the process of working, workers may finish their work at a first location, and a designated worker who is in charge of the warning system 150 can retrieve the encroachment unit 140 from its original location, remove it from the track by pulling it away from the web of the rail 102 and breaking the magnetic contact of the magnet mounting arrangement 146 with the rail 102. The worker may then carry the encroachment unit 140 down the track to a new second location where it may be magnetically attached to another section of rail. Thus the warning system 150 can be quickly and easily moved from one location to another by an individual designated worker. The reduction of on-track time for workers may promote safety.

An encroachment unit 140 may communicate with a V-ware unit 130 to identify violations of work block safety rules. For example, the encroachment unit 140 may be configured to provide warnings to rail vehicles as they are exiting the boundary limit of a designated work block, or as they are encroaching an unauthorized work block. Thus, an encroachment unit 140 may further comprise specially configured circuitry, processing capability, software programs, as well as one or more transceivers (transmitter and/or receiver) for communications with other devices. For example, a wireless transceiver in the encroachment unit 140 may communicate with a nearby V-aware unit 130 over a chirping radio link at about 2.4 Gigahertz (GHz).

As a result of chirp signals transmitted between itself and the vehicle 152, the encroachment unit 140 may determine a distance between them, and display such distance (with a warning symbol when applicable) on the display 144. On the other hand, based on the chirping radio the V-aware unit 130 may also determine a distance between the vehicle 152 and the encroachment unit 140. Chirp signals may take any form as long as a rough distance may be calculated or estimated based on the signals. The two units may calculate the distance independently, or one unit may calculate the distance and send it to the other. Either way, an operator of the vehicle 152 may tell how far the vehicle 152 is from a work block associated with the encroachment unit 140.

Figure 3:
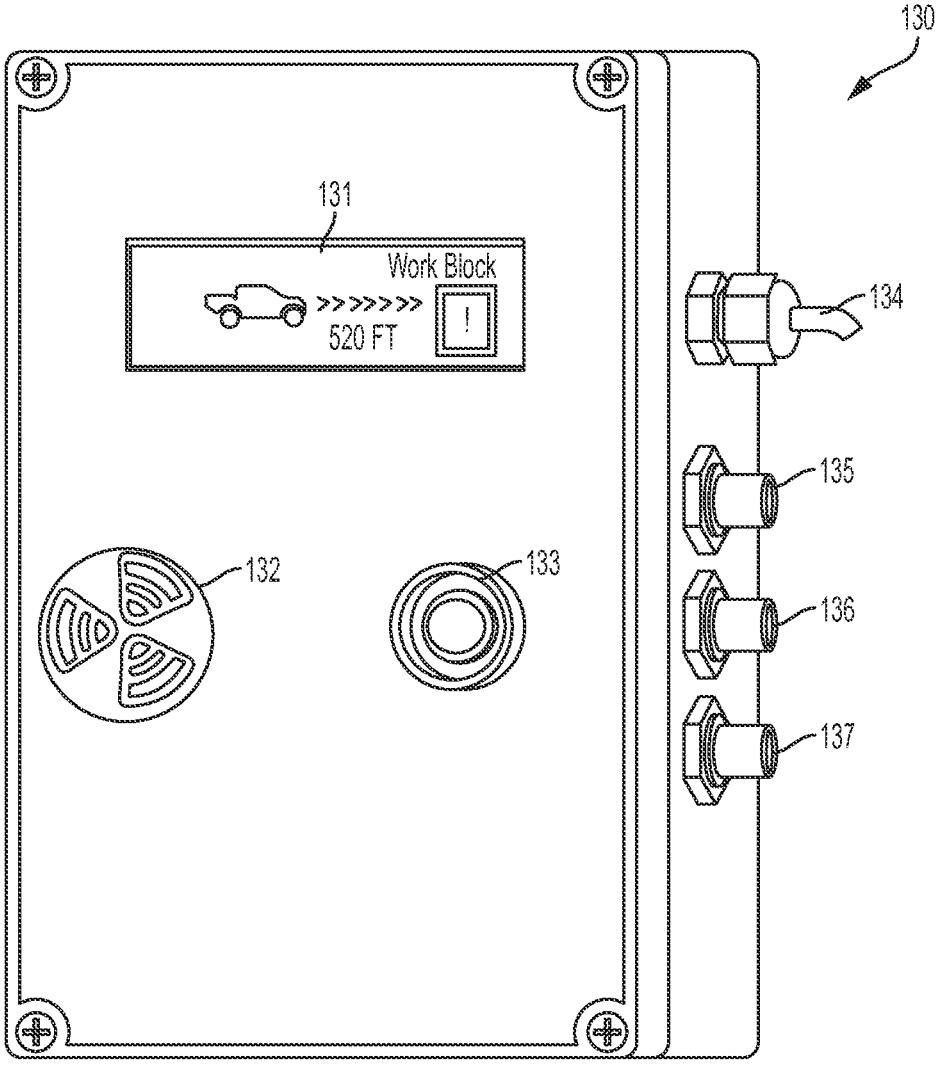
FIG. 3 illustrates a close-up perspective view of the V-aware unit shown in FIGS. 1 and 2.

FIG. 3 provides a close-up view of an exemplary embodiment of a V-aware unit 130. The V-aware unit 130, sometimes referred to as a collision avoidance unit or system, may be a device that communicates with an encroachment unit to recognize a boundary limit of a work block. The V-aware unit 130 may comprise, on the outside, a display 131, an audible alarm 132, a program setting button 133, a power connection 134, a GPS connection 135, a rear antenna connection 136, and a front antenna connection 137. It should be understood that the V-aware unit 130 may further comprise internal components, such as processors, memories, transceivers, etc., that work with the external components.

As shown in FIG. 3, when the V-aware unit 130 gets into a radio coverage range (e.g., 1200 feet) from an encroachment unit, the display 131 may show a warning message to an operator. A volume of the audible alarm 132 may be configured higher or lower by turning the audible alarm 132. For instance, the audible alarm 132 may be a standard off-the-shelf piezo audible alarm with a baffle, which may be turned to increase or decrease volume. Audible alarming may also be turned on and off. The button 133 may be used to set, change, or program various settings of the V-aware unit 130. The power connection 134 may be wired to vehicle power, e.g., between 18 and 75 direct current (DC) volts, that is provided when the vehicle engine is started or the vehicle electronics are started. The V-aware unit 130 may have any suitable number of transceivers coupled to any suitable number of antennas. For example, the two antenna connections 136 and 137 (rear and front) may be connected to coaxial cables, which in turn are connected to two antennas.

According to some aspects disclosed herein, the V-aware unit 130 may be used to mitigate potential accidents by informing the rail vehicle operator of potential safety rule violations. The V-aware unit 130 may be mounted inside the cab of multiple vehicles. The V-aware unit 130 may be installed where the display 131 is in clear view of the operator, or at any other appropriate position.

Referring back to FIG. 1, suppose an operator is driving the vehicle 114 in Block 2 toward a boundary limit of Work Block 3. A V-aware unit 130 located in the vehicle 114 may identify a safety rule violation based on a distance between the vehicle 114 and an encroachment unit located at about the boundary of Work Block 2 and Work Block 3. The display 131 of the V-aware unit 130 may show, in real time, a distance between the vehicle 114 and the closest encroachment unit 140. A calculated distance may be updated, intermittently or in real time, as the vehicle becomes closer to, or further away from, the closest encroachment unit 140. If multiple encroachment units 140 are within a communication range of a V-aware unit 130, the V-aware unit 130 may calculate and display the distance between itself and an encroachment unit that is getting closer and closer. Alternatively, the display 131 may simultaneously display multiple distances (e.g., distances to a rear encroachment unit and to a front encroachment unit).

A V-aware unit 130 may be used to determine distances between vehicles. For example, the V-aware unit 130 on the vehicle 114 may be a first V-aware unit that may communicate with a second V-aware unit installed on another vehicle 116. The first V-aware unit may determine and display a distance between the rail vehicle 114 and the vehicle 116 based on the communications between them. In some embodiments, the display 131 on the vehicle 114 may indicate a distance between itself and the closest vehicle either to the rear (e.g., the vehicle 112) or to the front (e.g., the vehicle 116).

Since a V-aware unit 130 may be installed at a fixed location on the vehicle 114, and an encroachment unit 140 may be attached at a fixed position relative to a boundary limit of a work block (e.g., at the start of Work Block 3), determining distances between these objects may have equivalent forms. For example, if a distance between the V-aware unit 130 and the encroachment unit 140 is known, one may easily determine a distance between the vehicle 114 and the start of Work Block 3. A calculated distance may be adjusted depending on where the V-aware unit 130 is located on the vehicle 114, depending on a length of the vehicle 114, or depending on whether the rail vehicle 114 has equipment mounted or coupled to its front or rear that extends the length of the vehicle 114.

The V-aware unit 130 may also issue visual alerts and/or audible alerts to the host operator when the vehicle 114 is approaching an end limit of a work block or another vehicle. Distances at which alarms are issued may be flexibly configured, such as 1000, 800, 600, 300, 200, 100, 75, 50, and 25 feet. The alarming distance may depend on a speed of the vehicle 114, which may be determined using a GPS module. For example, at higher speeds, the vehicle 114 may require a longer alarming distance to give sufficient time for the operator to act.

When a distance between a V-aware unit 130 and an encroachment unit 140 drops to or below a certain pre-determined threshold (e.g., 300 feet at high speeds, or 24 feet at low speeds), alarming mechanisms may be triggered. The audible alarm 132 may sound continuously, informing the vehicle operator of a potential collision hazard. There may also be pre-determined audio patterns. For instance, three beeps may sound when an approaching vehicle is closer than 75 feet, six beeps may sound when an approaching vehicle is closer than 50 feet, and beeping may be continuous when an approaching vehicle is closer than 25 feet.

A V-aware unit 130 or an encroachment unit 140 may record and keep data logs. In an embodiment, when a distance between an encroachment unit 140 and an approaching rail vehicle drops to or below a threshold, a violation of a safety rule by the rail vehicle may be identified by the V-aware unit 130, or the encroachment unit 140, or both. A memory device may store a data log at least when there is a violation of a safety rule. Stored data log may comprise information that indicates (1) a timestamp (e.g., date and time) of the violation, (2) an identification (ID) of the rail vehicle, and/or (3) the distance between the work block limit encroachment unit and the rail vehicle as determined at a time of the violation. The identification of the rail vehicle may be recorded in any suitable form as long as the rule-violating vehicle or its category can be identified.

The date and time of each event may be saved in an onboard memory of the V-aware unit 130. Additional events may be logged when the operator presses a button or makes changes to configuration settings. Further, data logging may be continuous or triggered by violation events. Exemplary events that trigger data logging may include distance threshold (proximity of 1000', 600', 300', 75', 50', and 25'), configuration changes, and button presses by the operator. A unit may log the timestamp at which any of these events had occurred, along with information about the event itself.

In some embodiments, when there is a violation (e.g., pre-determined based on distance), data that records the violation may be reported to an Operations Control Center ("OCC"), a command vehicle, or a supervisor that may be located away from the work site. Data may be transmitted wirelessly over GPS or cellular links. In dark territories where there are no GPS or cellular links, data may be transmitted to an OCC via radio communication links (e.g., at about 400 MHz). The unit may, alternatively or additionally, have transceivers that work near (at and close to) various frequencies such as 430 MHz, 220 MHz, 900 MHz, 2.4 GHz, global positioning system (GPS) frequencies, and cellular frequencies.

Both a V-aware unit 130 or an encroachment unit 140 may be configured to have GPS antennas to communicate with an OCC. Rule violations may be reported to the OCC or a shift supervisor by the V-aware unit 130, or the encroachment unit 140, or both. For example, the V-aware unit 130 may report the violation of a safety rule by sending out data that indicates a timestamp of the violation, an identification of the rail vehicle, and the distance between the work block limit encroachment unit and the rail vehicle as determined at a time of the violation. Reporting may take any suitable form, e.g., as an email or a text message.

Once the encroachment unit 140 is aware of the encroaching rail vehicle, the encroachment unit 140 may issue a warning to nearby rail workers (e.g., the visual alarm 142 flashing a visible flash light and/or the audible alarm 148 sounding a loud alarm) in order to instruct them to get off the track. The encroachment unit 140 may also send a warning signal to one or more personal alert devices carried by the rail workers. Personal alert devices such as 121, 123, and 125 may each have an audible alarm and a LED warning light. The personal alert devices may be positioned on each of the workers in the vicinity of the track, thus warning them of the presence of an encroaching vehicle, which the workers might not otherwise notice due to their concentration on their work or due to the high volume of noise that may be occurring in the workers' vicinity.

To work with embodiments of work block encroachment warning systems disclosed herein, rail personnel including onsite workers and supervisors at an operations control center may adapt procedural changes. Note that the procedures and processes are given for example only, thus they may be modified (e.g., some steps omitted and some added) within the principles described herein.

Mobile or fixed work zone personnel responsibilities may include using a V-aware unit, work block limit encroachment unit, portable warning horn and lights, and/or personal alert device in work blocks for various (e.g., all) types of track work. To provide a safer procedure for track access in order to perform track maintenance or repair in work zones during revenue hours or with test trains operating during repair.

According to some aspects of the present disclosure, a shift supervisor may authorize and assemble work maintenance crew to perform track work. The supervisor may select (or elect himself as) a qualified person of the work crew as the designated work crew coordinator to manage activities with the OCC and to provide on-track safety for all members of the work crew. Only a designated qualified person may request and initiate a track work area and should comply with safety procedures, policies, and standards in order to ensure optimum safety to all personnel.

According to some aspects of the present disclosure, work crew coordinator responsibilities may include the following:

1. Confirm that appropriate personnel are on site.
2. Confirm type of maintenance or repair with the shift supervisor and work crew.
3. Provide and supervise on-track safety guidelines for all crew members in and around the work area.
4. Possess, establish, and maintain adequate means of communications with OCC and the work crew throughout the maintenance operation.
5. Ensure proper clearance is obtained by OCC before entering the intended work area.

6. Conduct safety check to ensure that all required safety devices—including work area limit encroachment unit, and if applicable, portable warning horn and lights, and/or personal alert device—are obtained, tested, assigned, and positioned before work crew members enter any work area. Specifically,
   (a) Ensure that the work block limit encroachment units are placed at the end limits of the individual work areas within the work block.
   (b) Ensure that the work block limit encroachment units are turned on and functioning properly.
7. Coordinate all crew activities with OCC within the work area.
8. After completion of work, verify that all personnel and equipment are clear of the work area and accounted for and that the area is safe for train movement.

According to some aspects of the present disclosure, each individual crew member is responsible for following all on-track safety rules. All crew members may be required to adhere to all agency safety guidelines and personal protective equipment (PPE) requirements.

According to some aspects of the present disclosure, responsibilities of operating a rail vehicle may include the following:

1. Ensure that the vehicle is equipped with a V-aware unit and that the unit is operating as designed.
2. When operating an over the road hi-rail vehicle, ensure that the v-aware unit is turned off when the vehicle is off tracks (e.g., during transit to mounting area).
3. When operating a hi-rail dedicated vehicle (or when any vehicle is on the tracks):
   a. Keep V-aware unit turned on.
   b. Before entering mainline, call OCC for clearance and follow all proper rail movement rules and regulations.
   c. Maintain proper distance while traveling to work area.

According to some aspects of the present disclosure, OCC employee responsibilities may include the following:

1. Establish and maintain adequate means of communication with the work crew through the designated qualified person throughout the maintenance operation.
2. Ensure proper clearance is given to the work crew through the designated qualified person before entering the intended work area.
3. Ask the designated qualified person if all employees entering the work zone have all required PPE, work block limit encroachment unit, and if applicable, portable warning horn and lights and/or personal alert device are turned on and in position before work crew members enter any work area.
4. Prior to maintenance vehicles entering the track, ensure that all vehicles are equipped with the V-aware unit and that it is operational.
5. Coordinate all crew activities with the work crew via the designated qualified person.
6. Prior to a maintenance vehicle passing a work block limit encroachment unit and entering the work area, ensure that work crew is notified and clear of the vehicle dynamic outline.
7. After completion of work, verify that all personnel and equipment are clear of the work area and accounted for through the designated qualified person and that the area is safe for train movement.
8. After completion of work, verify that all maintenance vehicles are clear of mainline tracks.

According to some aspects of the present disclosure, shift supervisor responsibilities may include the following:

1. Obtain the required work block protection safety technology equipment using work block limit encroachment unit, portable warning horn and lights and/or personal alert device devices.
   a. Upon completion of initial function tests, turn off early warning devices in order to conserve power charge and prevent false warnings while moving to the designated work area.
2. Ensure that all vehicles being used are equipped with the work block/collision avoidance vehicle unit.
3. Perform an initial test of all equipment and warning devices, and ensure that all equipment and warning devices are properly signed-out according to applicable procedures.
4. Provide a job briefing to the work crew.
   a. Confirm attendance and duties of all assigned crew members.
   b. Specify location and nature of work/repair to be done.
   c. Specify safety guidelines and ensure proper PPE.
   d. Designate and assign duties to safety personnel (e.g., flagger, watchperson, and lookout).
   e. Assign work block limit encroachment unit, and if applicable, portable warning horn and lights and/or personal alert device to personal and instruct where the devices may be needed.
      i. After assignment, the designated qualified person may ask all crew members, "are all personal warning devices turned on?" The designated qualified person may then perform a supervisory function test in order to confirm that all warning devices are turned on and functioning properly to provide a secondary means of track area protection.
   f. Assign vehicles equipped with the work block/collision avoidance vehicle unit.
   g. Perform a test of all safety and warning devices.
5. Establish contact with the OCC and request track access by the following procedure:
   a. Give radio number;
   b. Report number in work crew;
   c. State the location of the work area;
   d. State nature of work and/or repairs (e.g., specify "minor repair" if applicable);
   e. If necessary, request a speed restriction; and
6. Upon obtaining and confirming proper clearance from the OCC, the designated qualified person may ensure the following:
   a. The crew possess adequate communications.
   b. Position work block limit encroachment unit at end limit of each work zone.
7. Where applicable, as per agency guidelines, install portable warning horn and lights, as a secondary means of work zone protection. All equipment shall be positioned as per agency procedures and guidelines. Once work block limit encroachment unit(s) are positioned in the work area, the designated qualified person may confirm with all crew members that all assigned devices are turned on.
   a. Ensure that all crew members are within voice communication range with the flagger(s)/watchperson(s)/lookout(s).
   b. Work may commence only after the designated qualified person has verified all information with the OCC and has confirmed that all safety equipment and work block limit encroachment unit(s) have been positioned, turned on and are functioning properly.

c. The designated qualified person may notify the OCC when any work vehicle is required to bypass a work block limit encroachment unit.
d. Crew members may notify the designated qualified person when any device is placed out of service.
e. The designated qualified person shall maintain communications with OCC and the work crew throughout the maintenance operation.
f. Give an update to OCC when required to do so by SOP's. Update OCC if additional time is anticipated.
g. Upon completion of track maintenance/repair, the designated qualified person may verify that all personnel and equipment are clear of tracks and accounted for and that the area is safe for train movement.
   i. Upon verification that the work block is clear of all tools, equipment, vehicles, and personnel, the designated qualified person shall confirm with all crew members that all assigned devices (work block limit encroachment unit, portable warning horn & lights and/or personal alert) are turned off in order to prevent false warnings.
   ii. The designated qualified person may then call the OCC and indicate track area is clear of personnel and equipment and release to OCC.
   iii. The designated qualified person shall be responsible for the collection, accountability and proper return of all safety equipment and warning devices according to agency sign off procedures.

In terms of work crew parameters, according to some aspects of the present disclosure, all crew members may be required to adhere to all agency safety guidelines and PPE requirements. Crew members shall not be permitted in the work block until given permission by the designated qualified person. All crew members may establish and maintain voice communication with designated flagger(s)/watchperson(s)/lookout(s). All crew members shall adhere to all designated safety personnel and warning devices and leave the work space when required. All crew members may be required to record any unauthorized violation of their work zone(s).

In terms of vehicle operator parameters, according to some aspects of the present disclosure, when traveling to their work zone, operators need to call OCC prior to their vehicle passing a work block limit encroachment unit. Once in their designated work zone, vehicles are free to travel within their work zone (between work limit encroachment units). Vehicles shall not pass a work limit encroachment unit unless permission is granted from OCC. Operators shall record any unauthorized violation of work zone.

In terms of OCC parameters, according to some aspects of the present disclosure, prior to admitting maintenance vehicle(s) to mainline tracks, the OCC shall ensure that all vehicles are equipped with the work block/collision avoidance unit. The OCC may determine whether multiple maintenance vehicles may travel as one consistent unit or individually to the work zone. If maintenance vehicles are traveling as one consistent unit, OCC may inform the vehicle operators (e.g., absolute block, distance between vehicles, etc.) of the traveling procedures.

According to some aspects of the present disclosure, prior to granting permission for a vehicle to cross into a work zone protected by the work limit encroachment unit, the OCC may ensure that work crews already in the work zone(s) are notified of vehicle movement, and that required work crew members have their personal alert devices turned on.

The present disclosure also describes a standard operating procedure for implementation and removal of a work block encroachment warning system for track crews. To provide a safe procedure for installing work block limit encroachment warning system, isolating individual work areas within a single work block may ensure safe working conditions for track workers from maintenance vehicles and potential human error.

According to some aspects of the present disclosure, the installation of work block limit encroachment warning systems may follow certain procedures. For example, work block limit encroachment units may be used whenever there is a defined work area within a work block. After confirming a work order, a designated qualified person shall install the required work block limit encroachment units. Work block limit encroachment units may be installed at the end limit of each work area within the work block. Prior to installing the work block limit encroachment units, the designated qualified person may establish contact with OCC and request track access by the following procedure:

1. Give radio number.
2. Report number of works in a work crew.
3. State the location of the work area.
4. State nature of work and/or repairs; give estimated work time.
5. If necessary, request a speed restriction.

Once OCC grants permission, the designated qualified person shall turn on and install the work block limit encroachment units. The designated qualified person shall maintain communications with OCC and the work crew throughout the maintenance operation.

According to some aspects of the present disclosure, removal of the work block encroachment units may follow certain procedures. Prior to removing the work block limit encroachment units the designated qualified person may establish contact with OCC and ask permission to remove work block limit encroachment units. Once OCC grants permission, the designated qualified person shall then remove the work block limit encroachment units and notify OCC when clear of the right of way.

Figure 4:
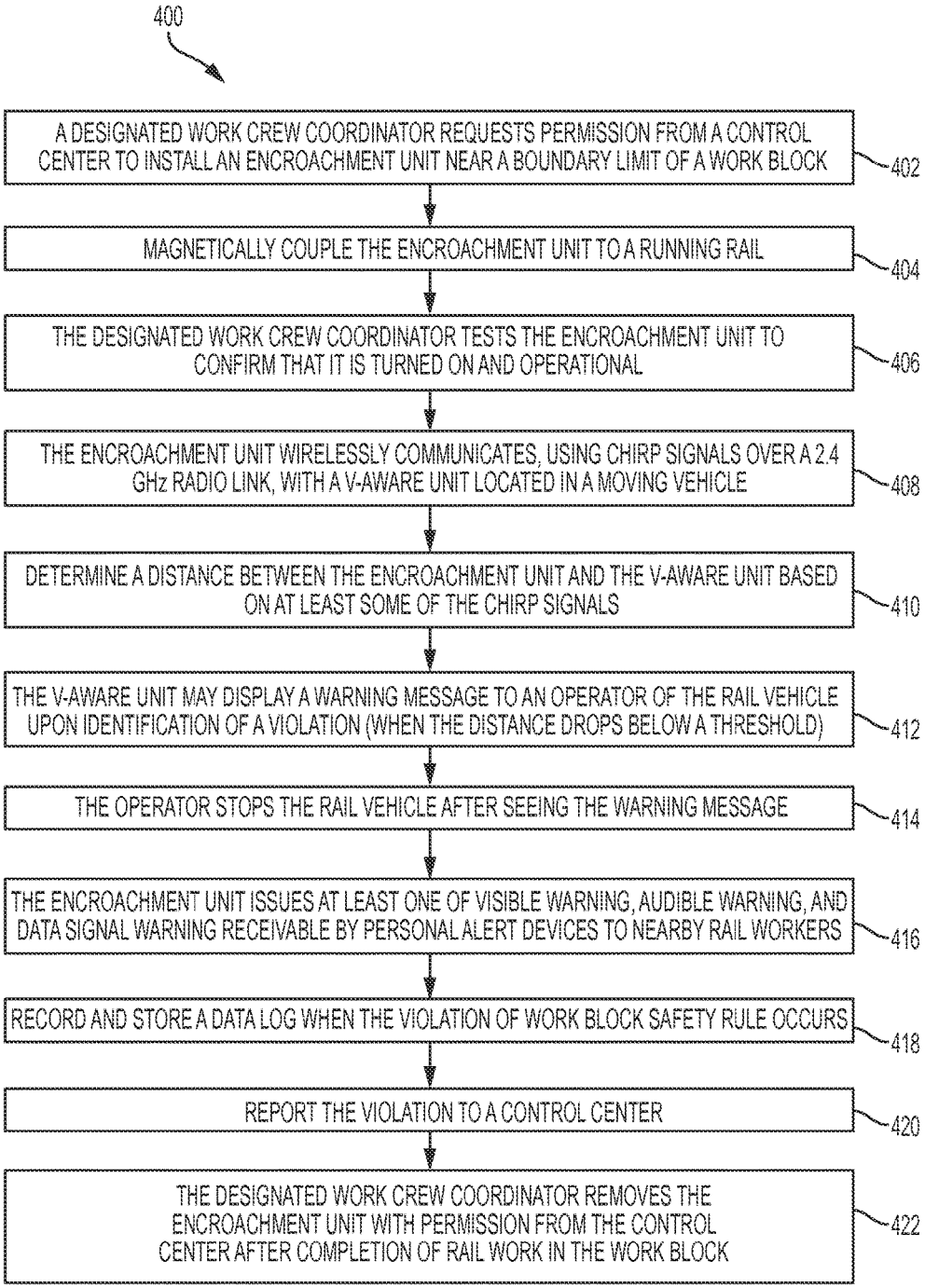
FIG. 4 is a flowchart illustrating an exemplary process for promoting worker safety using a work block encroachment warning system according to the present disclosure.

FIG. 4 is a flowchart illustrating a process 400 for promoting railroad safety via rail communications. The process 400 may be implemented in a work block limit encroachment warning system (e.g., the system 150), which may comprise a first unit mounted on the railroad (e.g., the encroachment unit 140 located on a starting boundary of Work Block 3) and a second unit located in a rail vehicle (e.g., the V-aware unit 130 installed on the rail vehicle 114). Note that the process 400 may be performed by various devices and personnel, and may not exhaustively list all steps necessary to use the system 150.

To start off at action 402, before rail workers enter the work block, a designated work crew coordinator may request permission from a control center to install an encroachment unit near a boundary limit of a work block. At action 404, the encroachment unit may be magnetically coupled to one rail. At action 406, the designated work crew coordinator may test the encroachment unit to confirm that it is turned on and operational. At action 408, the encroachment unit may wirelessly communicate (e.g., using chirp signals over 2.4 GHz radio link) with a V-aware unit located on a moving vehicle. At action 410, a distance between the encroachment unit and the V-aware unit may be determined based on at least some of the chirp signals. In an embodiment, when the distance drops to or below a threshold, a violation of work block safety rule by the moving rail vehicle is identified.

At action 412, the V-aware unit may display a warning message to an operator of the rail vehicle upon identification of the violation, wherein the warning message indicates the distance between the encroachment unit and the V-aware unit. At action 414, the operator may elect to slow down or stop the rail vehicle after the operator sees the warning message. Audio alarms may also be sounded to alert the operator.

Since there has been a violation, at action 416, the encroachment unit may issue at least one of visible warning, audible warning, and data signal warning receivable by personal alert devices to nearby rail workers. At action 418, a data log may be recorded, by the encroachment unit, or by the V-aware unit, or both, when the violation of work block safety rule occurs. The data log comprises information that indicates a time of the violation, an identification of the rail vehicle, and a distance between the first unit and the second unit at the time of the violation. At action 420, the violation may be reported to a control center, a command vehicle, or a supervisor, by sending the information. At action 422, after completion of rail work in the work block, the designated work crew coordinator may remove the first unit with permission from the control center. After unit removal, the designated work crew coordinator may verify with the control center that the work zone has been marked as clear.

Figure 5:
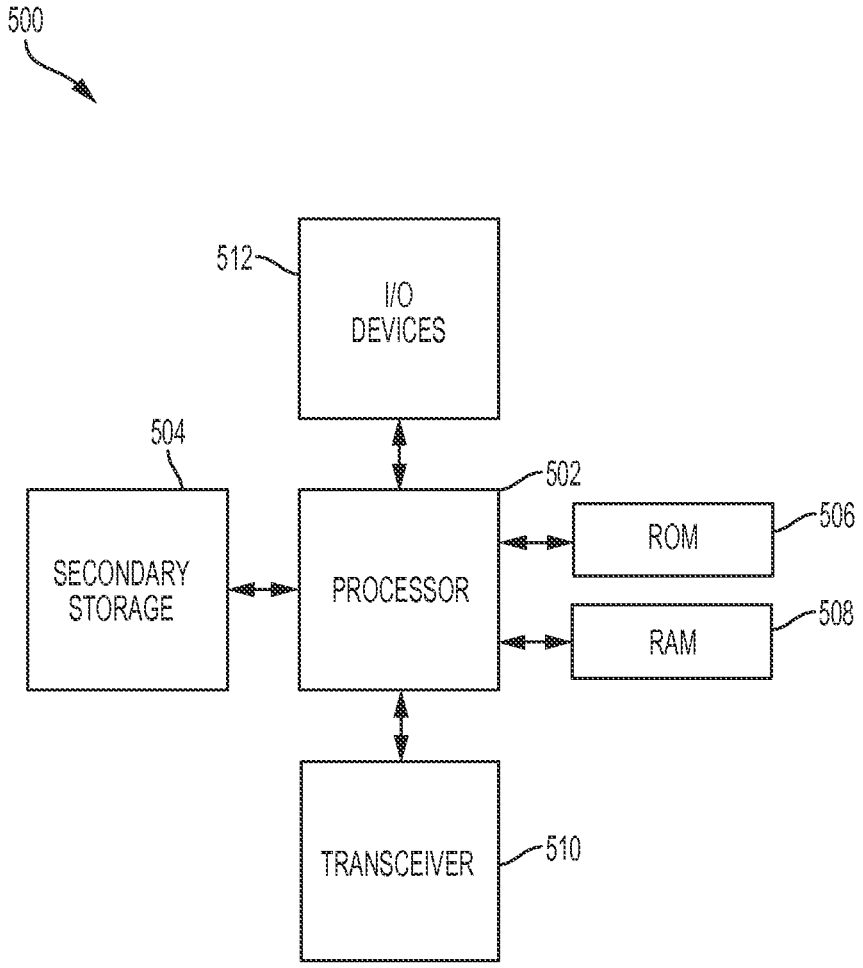
FIG. 5 is a schematic diagram illustrating a general-purpose computing device that may represent various units disclosed herein.

The methods and processes described herein may be implemented on any general-purpose computing device or system, such as a computer or a microcontroller with sufficient processing power, memory resources, and communication capabilities to handle the necessary workload placed upon it. FIG. 5 is a schematic diagram illustrating a general-purpose computing device 500 that may represent various units or systems disclosed herein. For example, the computing device 500 may be used as part of any of the V-aware units 130 and any of the encroachment units 140. The computing device 500 may implement one or more embodiments of the methods and processes disclosed herein, such as the process 400.

The computing device 500 may comprise a processor 502 (which may be referred to as a central processor unit or CPU), one or more memory devices (e.g., including secondary storage 504, read only memory (ROM) 506, and random access memory (RAM) 508), one or more transceivers 510. Although illustrated as a single processor, the processor 502 is not so limited and may comprise multiple processors. The processor 502 may be a unit capable of data processing, such as one or more CPU chips, cores (e.g., a multi-core processor), field-programmable gate arrays (FPGAs), application specific integrated circuits (ASICs), digital signal processors (DSPs), or combinations thereof. The processor 502 may be implemented using hardware (e.g., circuitry) alone or a combination of software and hardware.

The secondary storage 504 may be used for non-volatile storage of data and as an over-flow data storage device if the RAM 508 is not large enough to hold all working data. The secondary storage 504 may be used to store programs that are loaded into the RAM 508 when such programs are selected for execution. The ROM 506 may be used to store instructions and perhaps data that are read during program execution. The ROM 506 is a non-volatile memory device that typically has a small memory capacity relative to the larger memory capacity of the secondary storage 504. The RAM 508 is used to store volatile data and perhaps to store instructions. Access to both the ROM 506 and the RAM 508 is typically faster than to the secondary storage 504.

A transceiver 510 may serve as an output and/or input device of the computing device 500. For example, if the transceiver 510 is acting as a transmitter, it may transmit data out of the computing device 500. If the transceiver 510 is acting as a receiver, it may receive data into the computing device 500. The transceiver 510 may work with cables or act as wireless antennas. The transceiver 510 may take the form of modems, Ethernet cards, universal serial bus (USB) interface cards, serial interfaces, wireless transceiver cards such as code division multiple access (CDMA), global system for mobile communications (GSM), long-term evolution (LTE), worldwide interoperability for microwave access (WiMAX), GPS, and/or other air interface protocol radio transceiver cards, and other well-known devices capable of wireless communications. The transceiver 510 may enable the processor 502 to communicate with other devices via radio, GPS, or cellular interfaces. I/O devices 512 may include output devices such as a screen display or speaker and input devices such as buttons and dial pads.

It is understood that by programming and/or loading executable instructions onto the computing device 500, at least one of the processor 502, the RAM 508, and the ROM 506 are changed, transforming the computing device 500 in part into a particular machine or apparatus (e.g., a V-aware unit or an encroachment unit having the novel functionality taught herein). It is fundamental to the electrical engineering and software engineering arts that functionality that can be implemented by loading executable software into a computer can be converted to a hardware implementation by well-known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an ASIC, because for large production runs the hardware implementation may be less expensive than the software implementation. Often a design may be developed and tested in a software form and later transformed, by well-known design rules, to an equivalent hardware implementation in an ASIC that hardwires the instructions of the software. In the same manner as a machine controlled by a new ASIC is a particular machine or apparatus, likewise a computer that has been programmed and/or loaded with executable instructions may be viewed as a particular machine or apparatus.

While various embodiments of work block limit encroachment warning systems and related methods of using such systems have been described above, it should be understood that they have been presented by way of example only, and not limitation. Thus, the breadth and scope of the present disclosure should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, the description of a technology in the "Background" is not to be construed as an admission that technology is prior art to any invention(s) in this disclosure.

Neither is the "Brief Summary" to be considered as a characterization of the invention(s) set forth in the claims found herein. Multiple inventions may be set forth according to the limitations of the multiple claims associated with this disclosure, and the claims accordingly define the invention (s), and their equivalents, that are protected thereby. In all instances, the scope of the claims shall be considered on their own merits in light of the specification, but should not be constrained by the headings set forth herein.

What is claimed is:

1. A work block limit encroachment unit, deployed at about a boundary limit of a work block on a railroad, comprising:

a magnet mounting arrangement configured to magnetically couple to a running rail, the magnet mounting arrangement being removably attached to a web of the running rail;

one or more transceivers configured to wirelessly communicate with a V-aware unit located in a rail vehicle that is moving towards the work block, wherein the communication with the V-aware unit comprises sending and receiving chirp signals in a radio frequency band near about 2.4 GHz; and a processor configured to determine, based on the communication with the V-aware unit, a distance between the work block limit encroachment unit and the rail vehicle.

2. The work block limit encroachment unit of claim 1, further comprising at least one of visual and audio alarm components configured to issue warning to one or more nearby rail workers when the distance between the work block limit encroachment unit and the rail vehicle drops to or below a pre-determined threshold.

3. The work block limit encroachment unit of claim 1, wherein, when the distance between the work block limit encroachment unit and the rail vehicle drops to or below a pre-determined threshold, the one or more transceivers are further configured to warn rail workers by transmitting signals that are receivable by personal alert devices carried by the rail workers.

4. The work block limit encroachment unit of claim 1, further comprising a memory device configured to store a data log at least when the distance between the work block limit encroachment unit and the rail vehicle drops to or below a pre-determined threshold, thereby indicating a violation of a safety rule by an operator of the rail vehicle, wherein the stored data log comprises information that indicates a timestamp of the violation and an identification of the rail vehicle.

5. The work block limit encroachment unit of claim 1, wherein an occurrence of the distance between the work block limit encroachment unit and the rail vehicle dropping to or below a threshold indicates a violation of a safety rule by the rail vehicle, and wherein the one or more transceivers are further configured to report the violation of safety rule by sending out data that indicates:

a timestamp of the violation;

an identification of the rail vehicle; and the distance between the work block limit encroachment unit and the rail vehicle as determined at a time of the violation.

6. The work block limit encroachment unit of claim 5, wherein the data that identifies the violation is sent to an operations control center (OCC) over a global positioning system (GPS) communications link or a cellular communications link.

7. A work block encroachment warning system for railroad use comprising:

a V-aware unit configured to be installed on a rail vehicle, the V-aware unit comprising:

one or more transceivers configured to communicate with an encroachment unit coupled to a running rail, wherein the communication with the encroachment unit comprises receiving chirp signals in a radio frequency band near about 2.4 GHz; and a processor coupled to the one or more transceivers, the processor being configured to generally calculate, based on the chirp signals, a distance between the encroachment unit and the rail vehicle, and configured to recognize, based on the communication, a boundary limit of a work block associated with the encroachment unit.

8. The work block encroachment warning system of claim 7, wherein the V-aware unit further comprises:

a display configured to show the distance between the encroachment unit and the rail vehicle to an operator of the rail vehicle; and at least one of visual and audio alarm components configured to issue warning to the operator when the distance between the encroachment unit and the rail vehicle drops to or below a pre-determined threshold.

9. The work block encroachment warning system of claim 7, further comprising a memory device coupled to the processor and configured to store a data log, wherein the data log comprises information that identifies one or more rule violations by the rail vehicle, and wherein the information indicates a timestamp of the rule violation and a distance between the rail vehicle and the boundary limit of a work block at a time of the violation.

10. The work block encroachment warning system of claim 9, wherein the one or more transceivers are further configured to transmit the information that identifies the one or more rule violations to an operations control center (OCC).

11. The work block encroachment warning system of claim 7, wherein the V-aware unit is a first V-aware unit that is further configured to:

communicate with a second V-aware unit installed on a second vehicle;

display, by a screen on the first V-aware unit, a distance between the rail vehicle and the second vehicle based on the communication with the second V-aware unit.

12. The work block encroachment warning system of claim 7, further comprising the encroachment unit that communicates with the V-aware unit, wherein the encroachment unit is removably attached to an outer side of a web of the rail via magnetic coupling, and wherein the encroachment unit is configured to issue a warning to personal alert devices carried by workers in the work block when a distance between the rail vehicle and the boundary limit of the work block drops below a pre-set threshold.

13. A method for promoting railroad safety via rail communications, the method comprising:

magnetically coupling a first unit, associated with a work block, to a running rail, wherein the first unit is positioned at about an end of the work block; and wirelessly communicating, between the first unit and a second unit located in a rail vehicle, to identify a violation of a work block safety rule by the rail vehicle, wherein the rail vehicle is approaching the end of the work block from outside the work block, and wherein the communication between the first unit and the second unit comprises sending and receiving, between the first unit and the second unit, chirp signals in a radio frequency band near about 2.4 GHz;

and determining, based on the chirp signals, a distance between the first unit and the second unit, and wherein the violation of the work block safety rule is identified when the distance between the first unit and the second unit drops to or below a threshold.

14. The method of claim 13, further comprising:

displaying, on a display of the second unit, a warning message to an operator of the rail vehicle upon identification of the violation, the warning message indicating the distance between the first unit and the second unit; and stopping the rail vehicle, by the operator, after the displaying of the warning message.

15. The method of claim 13, further comprising issuing at least one of visible warning, audible warning, and data signal warning receivable by personal alert devices, to nearby rail workers for the rail workers to get off track, wherein the issuance of warning is performed by the first unit upon identification of the violation.

16. The method of claim 13, further comprising:

recording a data log at least when the violation of work block safety rule occurs, the data log comprising information that indicates a time of the violation, an identification of the rail vehicle, and a distance between the first unit and the second unit at the time of the violation; and reporting the violation to a control center by sending the information.

17. The method of claim 13, further comprising:

prior to rail workers entering the work block, requesting, by a designated work crew coordinator, permission from a control center to install the first unit;

testing the first unit by the designated work crew coordinator to confirm that the first unit is turned on and operational;

during or after rail work in the work block, reporting the violation of work block safety rule to the control center by at least one of the following personnel: the designated work crew coordinator, the rail workers, and an operator of the rail vehicle; and after the rail work in the work block, removing the first unit by the designated work crew coordinator with permission from the control center.

* * * * *